US006637854B2

(12) United States Patent
Serra et al.

(10) Patent No.: US 6,637,854 B2
(45) Date of Patent: Oct. 28, 2003

(54) METHOD AND APPARATUS FOR ALIGNING STAGGERED PENS USING MACRO-PENS

(75) Inventors: Josep Maria Serra, San Diego, CA (US); Antoni Murcia, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 171 days.

(21) Appl. No.: 09/919,566

(22) Filed: Jul. 30, 2001

(65) Prior Publication Data

US 2003/0020775 A1 Jan. 30, 2003

(51) Int. Cl.[7] ..... B41J 2/01
(52) U.S. Cl. ..... 347/19

(58) Field of Search ..... 347/19, 42, 43; 400/74

(56) References Cited

U.S. PATENT DOCUMENTS 4,675,696 A * 6/1987 Suzuki ..... 346/46
6,244,688 B1 * 6/2001 Hickman ..... 347/43

* cited by examiner

*Primary Examiner*—Craig Hallacher

(57) ABSTRACT

In accordance with an embodiment of the invention, a method of aligning plural staggered pens in a printer with a first pen and a second pen of the plural pens defining a macro-pen, the first and second pens being staggered, the method includes aligning the first and second pens of the macro-pen and aligning a third pen with the macro-pen.

25 Claims, 5 Drawing Sheets

METHOD AND APPARATUS FOR ALIGNING STAGGERED PENS USING MACRO-PENS

FIELD OF THE INVENTION

The present invention relates generally to multi-pen printers, and, more specifically, to alignment of staggered pens in multi-pen printers.

BACKGROUND OF THE INVENTION

Printers with multiple printheads, or pens, such as ink jet printers, for example, have historically had aligned pens. In this context, aligned means that the pens are substantially aligned in scan axis. A scan axis is the path along which the pens, typically transported by a carriage, may travel when the printer is in operation. In such printers, aligning the printheads, or, more specifically, aligning what the pens print on a media is typically accomplished by using one pen as a reference and then aligning the other pens to that reference.

One advance in print technology is the use of staggered pens. Printers with staggered pens may have certain advantages over printers with non-staggered pens, such as improved print quality and/or improved print speed. However, conventional methods for aligning pens in printers with staggered pens may have certain disadvantages. For example, using one pen as a reference and aligning the other pens to that reference may introduce undesired errors into alignment of such pens due to, for example, media advance errors or media path skew. Therefore, alternative approaches for aligning staggered pens in multi-pen printers are desirable.

SUMMARY OF THE INVENTION

In accordance with an embodiment of the invention, a method of aligning plural staggered pens in a printer with a first pen and a second pen of the plural pens defining a macro-pen, the first and second pens being staggered, the method includes aligning the first and second pens of the macro-pen and aligning a third pen with the macro-pen.

DETAILED DESCRIPTION OF THE INVENTION

Figure 1:
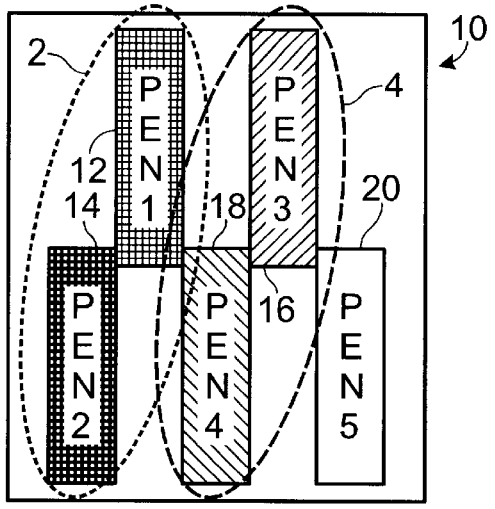
FIG. 1 is a high-level schematic drawing staggered pen arrangement that may be employed in accordance with the invention.

Referring first to FIG. 1, a multiple staggered pen arrangement 10 is illustrated in a high level schematic drawing. This pen arrangement includes five pens, designated pen 12 (PEN1), pen 14 (PEN2), pen 16 (PEN3), pen 18 (PEN4) and PEN5 18, though the invention is not limited to this particular arrangement nor any particular number or combination of pens. For pen arrangement 10, the five pens would typically include a combination of black pens and color pens, as is known in aligned printers. For example pens pen 12 (PEN1) and pen 14 (PEN2) may include black pens, while pens pen 16 (PEN3), pen 18 (PEN4) and pen 20 (PEN5) may include, respectively, yellow, cyan and magenta pens, though other arrangements are possible. The shading indicated for these pens in FIG. 1 is consistent throughout the figures for those pens, and for blocks indicated as being printed by the respective pens.

Additionally, pen arrangement 10 includes macro-pen 2 and macro-pen 4. As indicated in FIG. 1, macro-pen 2 includes what may termed sub-pens pen 12 (PEN1) and pen 14 (PEN2). Likewise, macro-pen 4 includes pen 16 (PEN3) and pen 18 (PEN4). In such a configuration, pen 20 (PEN5) may be termed an individual pen, as it is not paired with another pen to form a macro-pen. For purposes of this disclosure, the terms pen, sub-pen and individual pen may be considered interchangeable. As will be discussed in more detail hereinafter, employing macro-pens, such as macro-pens 2 and 4, may provide certain advantages in aligning pens for staggered pen arrangements, such as pen arrangement 10.

In this regard, pen arrangement 10 (illustrated in FIG. 1) is what may be termed a partially staggered arrangement. Partially staggered, in this context, means there is some vertical overlap between the pens. Such an overlap may have certain advantages for alignment of such pens, as is discussed in more detail hereafter. Other pen arrangements are, of course possible. For example, a totally staggered arrangement may be employed where no overlap between pens exist. The particular arrangement of pens will depend, at least in part, on the particular embodiment.

Figure 2:
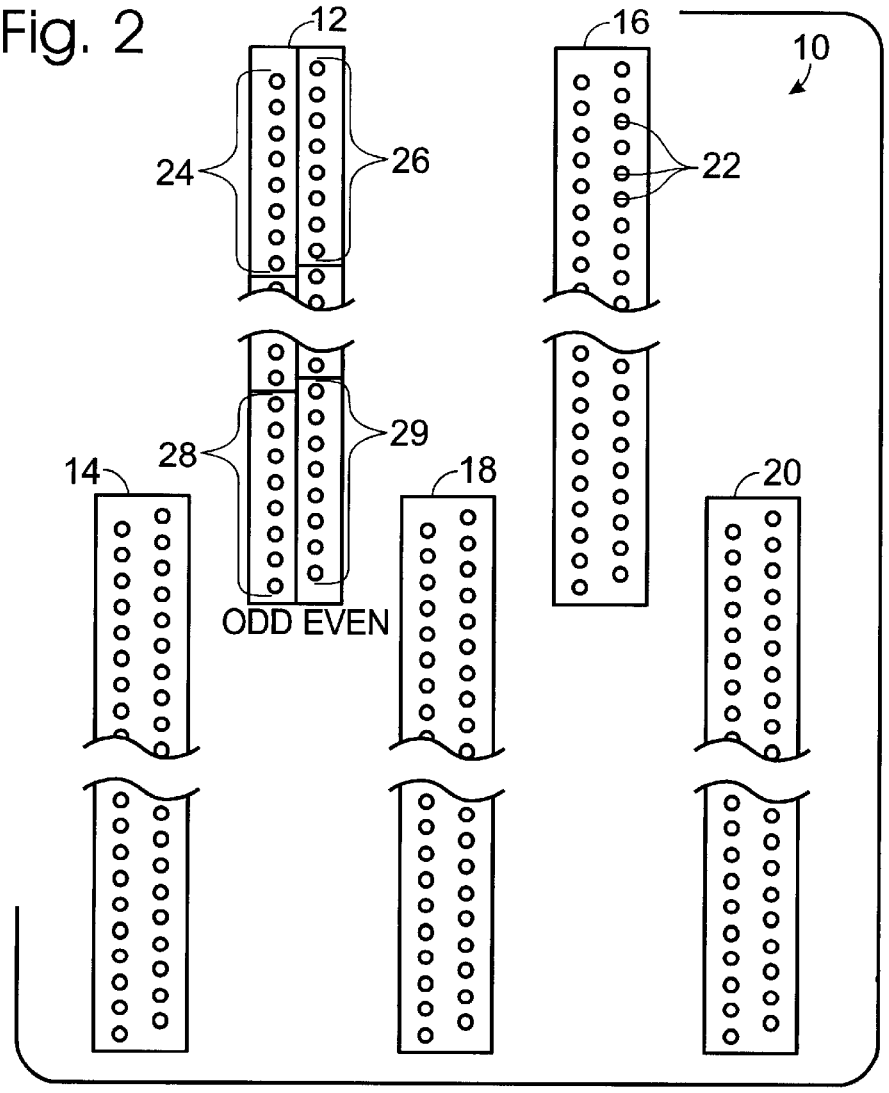
FIG. 2 is a more detailed schematic drawing of the staggered pen arrangement illustrated in FIG. 1, illustrating a nozzle arrangement of the pens.

FIG. 2 is a drawing illustrating a more detailed schematic view of pen arrangement 10. For purposes of clarity, macro-pens 2 and 4 are not indicated on the drawing but would include the sub-pens indicated above with respect to FIG. 1. The pens shown in FIG. 2 include a plurality of nozzles 22, such as pens employed in ink-jet printers, for example. The arrangement shown in FIG. 2 is substantially similar to that shown in FIG. 1. The spacing of the pens in FIG. 2 is illustrative of the fact that such pens would, in operation, normally be housed in a carriage, and such spacing would be typical.

As was indicated with respect to FIG. 1, the pens in FIG. 2 are shown in a partially staggered arrangement. In such an arrangement, there is overlap of the pens in one level with the pens in an adjacent level of the pen arrangement. In this regard, the pen arrangement shown in FIG. 2 includes two rows. A first row includes pens pen 12 (PEN1) and pen 16 (PEN3), and a second row includes pens pen 14 (PEN2), pen 18 (PEN4) and pen 20 (PEN5). This arrangement results in overlap between the nozzles of adjacent rows of such a pen arrangement. As was indicated above, such an arrangement may have certain advantages, which are discussed below.

The pens depicted in FIG. 2 are shown with an illustrative break, as such pens may include various numbers of nozzles. For example, pens with 500 or more nozzles may be employed in such an arrangement. For purpose of this discussion, though the invention is not so limited, pens with 524 nozzles will be discussed. For such pens, only a portion of the 524 nozzles per pen is typically used in operation. For example, 512 nozzles may be active while 12 nozzles are inactive. This is advantageous as, in a partially staggered configuration, it may allow for alignment of such pens relative to one another by modifying the active nozzles of one or more pens. Because, in this scenario, 12 nozzles per pen may be inactive, this would allow for changing the active nozzles to align what each pen prints relative to the others. For example, if pen 12 (PEN 1) were, initially, to have 4 inactive nozzles at the top of the pen and 8 inactive nozzles at the bottom of the pen, that pen may be adjusted as many as 4 nozzles "up" or as many as 8 nozzles "down", for example, assuming that 512 contiguous nozzles remain active.

For embodiments in accordance with the invention, such nozzles may also be grouped into sets, or what may be termed logical primitives, such as 24, 26, 28 and 29. The number of nozzles in such a logical primitive may vary and will depend, at least in part, on the particular embodiment. In this regard, a logical primitive may include a single nozzle, or may include an entire column of nozzles for such a pen.

While illustrated with eight nozzles per logical primitive in FIG. 2, typically, for a pen having 524 nozzles, a logical primitive may include, for example, thirty-two nozzles, which would correspond to 8 logical primitives per column or 16 per pen. The groupings of one column of nozzles may also be treated as a first set of logical primitives, termed ODD primitives hereafter, and the groupings of the other column of nozzles as a second set of logical primitives, termed EVEN primitives hereafter. These designations are shown with respect to pen 12 (PEN1) in FIG. 2. Such grouping of nozzles as logical primitives may be advantageous, as each logical primitive may be aligned as a group. Such an approach may, in turn, simplify the alignment of such pens, as nozzles would not be aligned individually using such a technique. As is known, individual alignment of nozzles may be relatively complex. Likewise, aligning the pens as a whole, without such groupings, or with an entire column as a grouping, may not result in acceptable alignment due to variations across each pen. Therefore, grouping nozzles in this manner may allow for, depending on the particular embodiment, trading off between precision of alignment and simplification of alignment.

Figure 3:
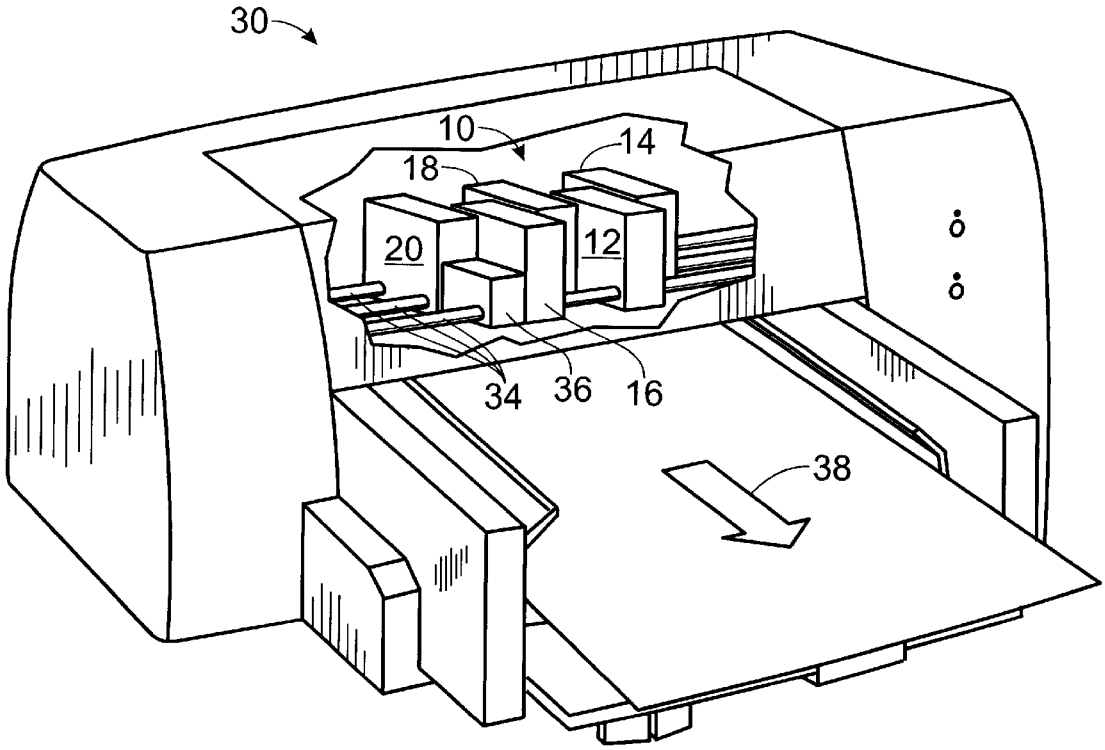
FIG. 3 is an isometric view of a printer configured to employ a pen alignment system in accordance with one embodiment of the invention.

FIG. 3 illustrates a printer 30, which employs a pen alignment system in accordance with the invention. Printer 30 is shown in an isometric, partial sectional view. An attendant sensor 36 is shown in high-level schematic form. This sensor may scan test block patterns to determine relative distances between the various components of such patterns by sensing the patterns and/or edges of those patterns. Printer 30 also employs staggered pen arrangement 10, such as illustrated in FIGS. 1 and 2. For simplicity of illustration, the pen arrangement is shown without a carriage, which would typically house such pens. The carriage may, in operation, travel along a scan axis of the printer on rod set 34, which substantially defines the scan axis. The print media would typically travel along a media advance axis, such as in the direction indicated by arrow 38 for this embodiment. The invention is, of course, not limited to the use of any particular printer or sensor, and many possible alternatives exist.

Figure 4:
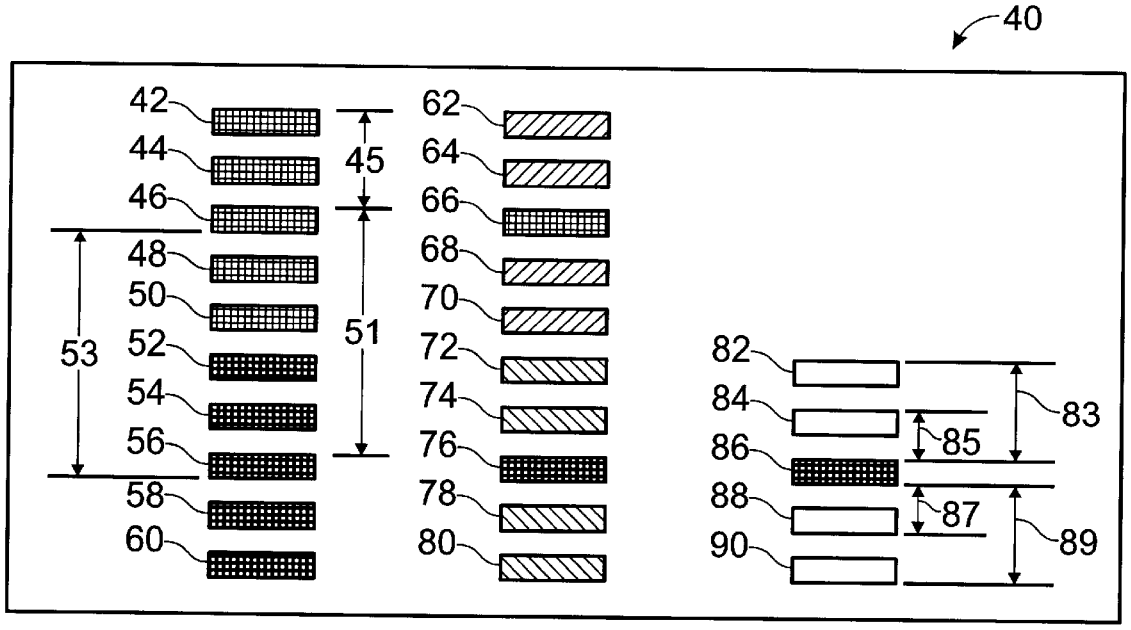
FIG. 4 is a drawing illustrating a test block pattern that may be employed to align macro-pens and individual pens in a media advance axis in accordance with the invention.

FIG. 4 illustrates a test block pattern 40 that may be employed to align macro-pens and individual pens in a media advance axis, such as the media advance axis indicated in FIG. 3. In this regard, pattern 40 includes three columns. The leftmost column includes five blocks printed with each of the sub-pens of macro-pen 2. For pen 12 (PEN1), the five blocks include 42, 44, 46, 48 and 50. Likewise, for pen 14 (PEN2), the five blocks include 52, 54, 56, 58 and 60. For this column, any of the five blocks may be selected as a reference for aligning the sub-pens. However, for the sake of consistency with the other two columns in FIG. 4, blocks 46 and 56 will be referred to as the references for the leftmost column.

In this respect, FIG. 4, therefore, contains a plurality of references 46, 56, 66, 76 and 86 printed with sub-pens pen 12 (PEN1) and pen 14 (PEN2) of macro-pen 2. The references are printed with sub-pens pen 12 (PEN1) and pen 14 (PEN2) and have shading that is consistent with the shading used in FIG. 1 for those pens, as was previously discussed. As was also indicated above, for printers with aligned pens, typically one pen is used as a reference and the remaining pens are aligned to that reference. However, for staggered pen arrangements, such as pen arrangement 10, using only one pen of such an arrangement to print all references may introduce errors, such as media advance errors, into the alignment process. Use of macro-pens, such as macro-pens 2 and 4, may reduce the effects of such errors because references 46, 56, 66, 76 and 86 are printed without advancing the print media.

Test block pattern 40, illustrated in FIG. 4, also includes a plurality of alignment blocks printed with the macro-pens and individual pens of pen arrangement 10. The references and the alignment blocks would typically be printed with a predetermined subset of active nozzles of the macro-pens and individual pens of pen arrangement 10. The predetermined subset of nozzles may or may not, depending on the embodiment, correspond with the logical primitive groupings discussed earlier. Looking at the leftmost column in FIG. 4, alignment blocks 42, 44, 48 and 50 are printed by sub-pens pen 12 (PEN1) of macro-pen 2 and oriented on either side of reference 46. Likewise, alignment blocks 52, 54, 58 and 60 are printed with sub-pen pen 14 (PEN2) of macro-pens 2 and oriented on either side of reference 56. Such an arrangement may allow for alignment of sub-pens pen 12 (PEN1) and pen 14 (PEN2) of macro-pen 2 in the media advance axis.

In this regard, by scanning the leftmost column in FIG. 4 with sensor 36 in the media advance axis, relative distances between the macro-pen references and the alignment blocks may be measured. Since the macro-pen references are printed without any media advance, errors due to, for example, media advance inaccuracy would typically not be introduced into such measurements. Based on comparison of these measurements to each other and to expected distances, adjustments to operation of the pens may be made to account, at least in part, for any misalignment between the sub-pens in the media advance axis. For example, misalignment of sub-pen pen 12 (PEN1) to sub-pen pen 14 (PEN2) may be determined. In this regard, it may be determined that sub-pen pen 12 (PEN1) is printing alignment marks 42, 44, 48 and 50 at distances above reference 56, printed with sub-pen pen 14 (PEN2), that are greater or less than an expected distance for such patterns, such as the distance indicated at 51. Likewise, it may be determine that sub-pen pen 14 (PEN2) is printing alignment marks 52, 54, 58 and 60 at distances below reference 46, printed with sub-pen pen 12 (PEN1), that are greater or less than expected distances between the reference and the alignment blocks, such as the distance indicated at 53. In this context, expected distances would typically correspond to theoretical distances for such a pattern, as it would be printed with properly aligned pens. Accordingly, the set of active nozzles for sub-pen pen 12 (PEN1) may be adjusted to compensate, at least in part, for such misalignment. Alternatively, adjustments to the set of active nozzles for sub-pen PEN2 or adjustments to the set of active nozzles of both sub-pens may be made. Such adjustments, as were previously discussed, may be implemented by various techniques, such as via software or firmware.

Additionally, the distances of the alignment blocks for each of the sub-pens from their respective references may be determined, such as the distance indicated at 45. Based on these distances, taking into account any adjustments made for misalignment of the sub-pens of macro-pen 2, a pen "width" or pad factor may be determined. In this context, pad factor is the printable swath of a given pen compared to a target swath, based on, at least in part, typical nozzle spacing. Pad factor may be useful for determining, for example, any adjustments to media advance that may be desired to reduce, for example, banding that may occur from advancing the print media more than the pen "width."

Referring to the center column of FIG. 4, alignment blocks for macro-pen 4 are printed along with references 66 and 76. Alignment blocks 62, 64, 68 and 70 are printed with sub-pen pen 16 (PEN3) of macro-pen 4 and oriented on opposing sides of reference 66, which is printed with sub-pen pen 12 (PEN 1) of macro-pen 2. Likewise, alignment blocks 72, 74, 78 and 80 are printed with sub-pen pen 18 (PEN4) and oriented on opposing sides of reference 76, which is printed with sub-pen pen 14 (PEN2) of macro-pen 2.

For this embodiment, by scanning the center column of FIG. 4 with sensor 36 in the media advance axis, relative distances between the macro-pen 2 references and the macro-pen 4 alignment blocks may be measured. Examples of such distances are show with respect to pen 20 (PEN5) at 83, 85, 87 and 89. Since the references and alignment blocks are printed without any media advance, errors due to such media advance would typically not be introduced into such measurements. Based on comparison of these measurements to each other and comparison to expected values, adjustments to the operation of the sub-pens of macro-pen 4 may be made to account, at least in part, for any misalignment between the two macro-pens and the sub-pens of macro-pen 4. It is noted that adjustments made in the alignment of the sub-pens of macro-pen 2 would also typically be taken into account in aligning macro-pen 4 with macro-pen 2 in the media advance axis because references 66 and 76 are typically printed with macro-pen 2 prior to alignment of its sub-pens. This is advantageous, as the references being printed without any media advance may reduce alignment errors.

Referring to the rightmost column of FIG. 4, alignment blocks for individual pen 20 (PEN5) are printed along with reference 86. Alignment blocks 82, 84, 88 and 90 are printed with individual pen 20 (PEN5) and oriented on opposing sides of reference 86, which is printed with sub-pen pen 14 (PEN2) of macro-pen 2. By scanning the rightmost column of FIG. 4 with sensor 36 in the media advance axis, relative distances between the macro-pen 2 reference 86 and the individual pen 20 (PEN5) alignment blocks may be measured, such as the distances indicated at 83, 85, 87 and 89. Individual pen 20 (PEN5) may be aligned in the media advance axis with macro-pen 2 in a similar fashion as described above with respect to aligning macro-pen 4 with macro-pen 2. However, since individual pen 20 (PEN5) has no counterpart pen, as with macro-pens 2 and 4, the alignment of that pen would typically be done with respect to sub-pen pen 14 (PEN2) of macro-pen 2, taking into account any adjustments made to the active nozzle set of that pen during alignment of the sub-pens of macro-pen 2 in the media advance axis.

Figure 5:
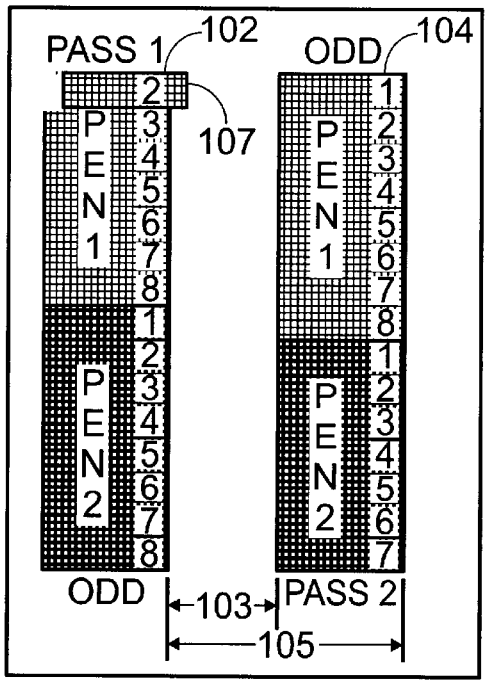
FIGS. 5–8 are drawings illustrating test block patterns that may be employed to align macro-pens in a scan axis in accordance with the invention.
Figure 6:
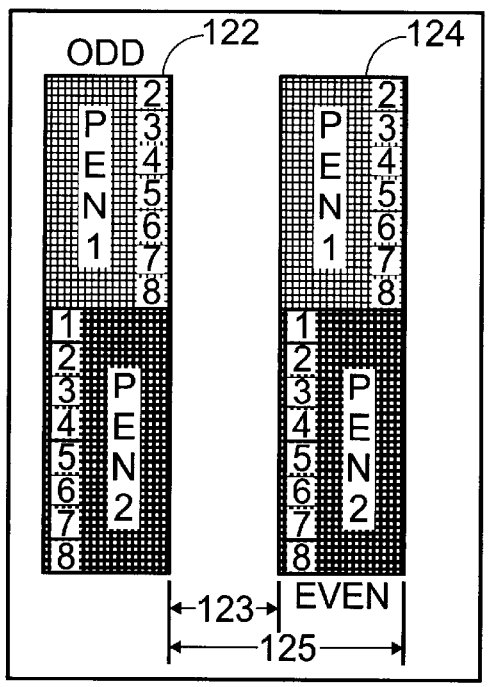

FIGS. 5 and 6 are drawings illustrating embodiments of test block patterns 100 and 120 that may be employed for aligning sub-pens of a macro-pen in a printer scan axis in accordance with the invention. Referring specifically to FIG. 5, test block pattern 100 includes sub-patterns 102 and 104 that may be employed for aligning a first set of logical primitives of the two sub-pens pen 12 (PEN 1) and pen 14 (PEN2) of macro-pen 2 in the scan axis. While repetition of the patterns may improve alignment accuracy, one instance of the patterns would typically be sufficient for practicing embodiments of the invention. Of course, the invention is not limited in scope in this respect, and any number of instances or combinations of appropriate test block patterns is possible.

In this regard, as was previously discussed, the logical primitives of the left column of nozzles of the sub-pens may be considered to be the ODD logical primitives of macro-pen 2. Likewise, the logical primitives of the right column of nozzles may be considered to be the EVEN logical primitives of macro-pen 2. As indicated in FIG. 5, sub-pattern 102 may be printed on a first pass of the pens over a print media and sub-pattern 104 may be printed on a second pass of the pens over the print media after a media advance corresponding to a single logical primitive length. These sub-patterns would both typically be printed with only the ODD logical primitives or only the EVEN logical primitives.

For this particular embodiment, there are eight ODD logical primitives and eight EVEN logical primitives. That is, each sub-pen includes sixteen logical primitives, eight in each column. Therefore, macro-pens 2 and 4 each include thirty-two logical primitives, sixteen ODD and sixteen EVEN. In this regard, sub-pattern 102 is printed on a first pass of pen arrangement 10 with the "bottom" seven ODD logical primitives of sub-pen pen 12 (PEN1) and all eight ODD logical primitives of sub-pen pen 14 (PEN2), or the "bottom" fifteen logical primitives of macro-pen 2.

As previously indicated, prior to printing sub-pattern 104, a media advance may occur. This media advance would typically be of an amount corresponding to the typical length of one logical primitive in the media advance axis. Because the media advance is one logical primitive, which would typically be less than the length of a sub-pen, and alignment in the media advance axis may be performed without a media advance prior to alignment in the scan axis, the likelihood of any alignment errors due to such media advances are reduced. After such a single logical primitive media advance, sub-pattern 104 may be printed on a second pass of pen arrangement 10 employing the "top" fifteen ODD logical primitives of macro-pen 2. The combination of sub-patterns 102 and 104 may then be employed to align the first set of logical primitives of macro-pen 2 in the scan axis.

In this regard, by scanning sub-patterns 102 and 104 in the scan axis, relative distances between the logical primitives of each sub-pattern may be determined. For example, the distances indicated at 103 and 105 may be measured for each pairing of ODD logical primitives. As can be seen from FIG. 5, sub-patterns 102 and 104 may allow comparison of the ODD logical primitives of sub-pen pen 12 (PEN 1) to corresponding logical primitives of that sub-pen, such as ODD logical primitive 2 of PEN1 in sub-pattern 102 and ODD logical primitive 1 of PEN1 in sub-pattern 104. Likewise, the ODD logical primitives of sub-pen pen 14 (PEN2) may be compared to corresponding ODD logical primitives of that pen, such as ODD logical primitive 8 and ODD logical primitive 7 of sub-pen pen 14 (PEN2). Additionally, the ODD logical primitives of sub-pen pen 12 (PEN1) may be compared with the ODD logical primitives of sub-pen pen 14 (PEN2), such as ODD logical primitive 8 of PEN1 in sub-pattern 102 and ODD logical primitive 1 of PEN2 in sub-pattern 104.

A representative misalignment is shown at 107. Here, ODD logical primitive 2 of sub-pen 12 (PEN1) is shown to be out of alignment with ODD logical primitive 1 of sub-pen pen 12. As was previously discussed, such misalignment of the logical primitives of macro-pen 2 in the scan axis may be determined from the relative distances between sub-patterns 102 and 104 and may be compensated for, at least in part, by adjusting firing times for the nozzles of one or more logical primitives of that set. In this respect, depending on the misalignment, the firing times may be adjusted to fire the nozzles earlier or later. Various techniques for implementing such adjustments exist, such as employing software or firmware, and the invention is not limited in scope to any particular method or technique.

For this particular embodiment, after aligning the ODD logical primitives of macro-pen 2, the EVEN logical primitives of macro-pens 2 may then be aligned with the ODD logical primitives of macro-pen 2 by employing test block pattern 120, illustrated in FIG. 6. As was indicated above, sub-patterns 122 and 124 of FIG. 6 would typically be sufficient in accomplishing such an alignment. However, such patterns may be repeated to increase alignment accuracy. In this respect, sub-pattern 122 may be printed with the ODD logical primitives of macro-pen 2 and sub-pattern 124 may be printed with the EVEN logical primitives of macro-pen 2.

By scanning sub-patterns 122 and 124 with sensor 36 in the scan axis, relative distances between the patterns for each logical primitive may be acquired, such as the distances indicated at 123 and 125. In turn, any misalignment in the scan axis between the ODD and EVEN logical primitives may be determined by comparing these distances to one another and to expected values, as has been previously discussed. Any misalignment between the ODD and EVEN logical primitives of macro-pen 2 in the scan axis may be compensated for, at least in part, by adjusting firing times for the nozzles of one or more logical primitives. Typically, such adjustments would be made to the EVEN logical primitives, as the ODD logical primitives would have been previously aligned in the scan axis for this embodiment, as was discussed with regard to FIG. 5.

Figure 7:
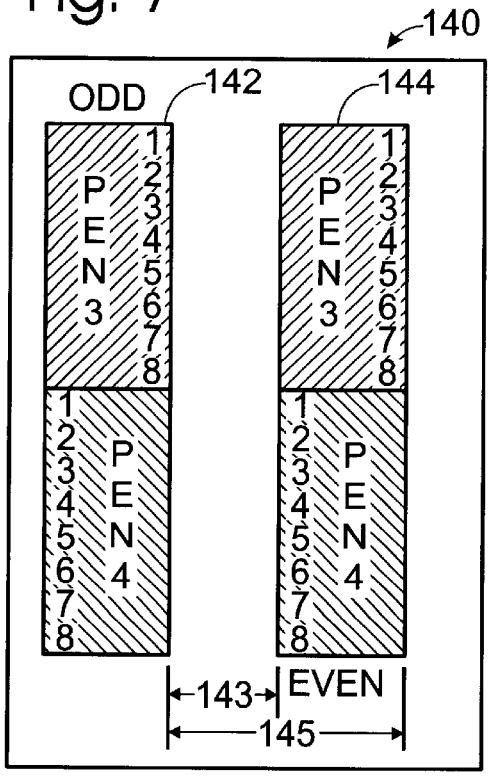
Figure 8:
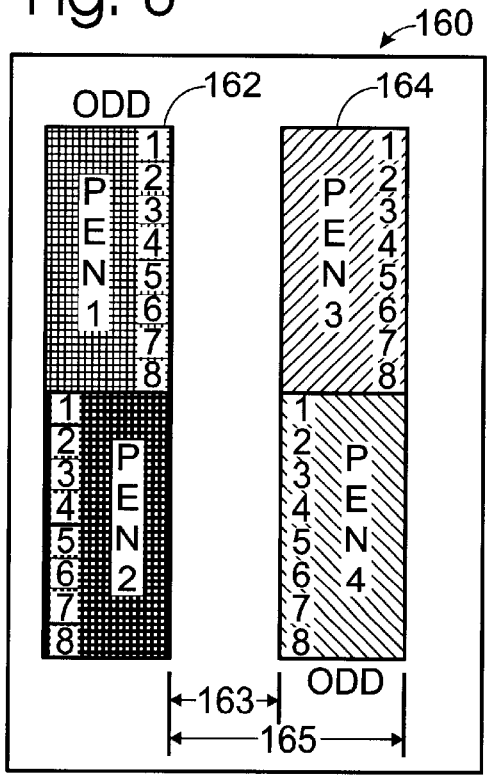

FIGS. 7 and 8 are drawings illustrating embodiments of test block patterns 140 and 160 that may be employed for aligning other macro-pens with a first macro-pen, such as previously aligned macro-pen 2, in the scan axis. Referring specifically to FIG. 7, an embodiment of a test block pattern 140 that may be employed for aligning the ODD logical primitives of a second macro-pen 4 with the EVEN logical primitives of that macro-pen in accordance with the invention is illustrated. In this respect, sub-patterns 142 and 144; and distances 143 and 145 may be employed for aligning the ODD and EVEN logical primitives of macro-pen 4 in a similar manner as sub-patterns 122 and 124 of FIG. 6 were employed to align the ODD and EVEN logical primitives of macro-pen 2. Therefore, that discussion will not be repeated in the interest of brevity. It is noted, however, that similar patterns and techniques may be employed to align the logical primitives of additional macro-pens, and the invention is not limited in scope to embodiments including any particular number of macro-pens.

FIG. 8 is a drawing illustrating a test block pattern 160 that may be employed for aligning a first macro-pen 2 with a second macro-pen 4. Such a technique, as will now be described, may also be employed for aligning additional macro-pens with the first macro-pen. As was similarly indicated with respect to FIGS. 5–7, sub-patterns 162 and 164 would typically be adequate to accomplish such an alignment, though additional instances of these sub-patterns may be advantageous in certain respects, such as additional alignment accuracy. As indicated in FIG. 8, sub-pattern 162 may be printed with the ODD logical primitives of previously aligned macro-pen 2 and sub-pattern 164 may be printed with the ODD logical primitives of macro-pen 4.

By scanning sub-patterns 162 and 164 with sensor 36 in the scan axis, relative distances between the patterns for each logical primitive may be acquired, such as the distances indicated at 163 and 165. In turn, any misalignment in the scan axis between macro-pen 2 and macro-pen 4 may be determined by comparing those distances with each other and with expected values. Such misalignment between the ODD logical primitives of the macro-pens in the scan axis may be compensated for, at least in part, by adjusting firing times for the nozzles of one or more logical primitives of those pens. Typically, such adjustments would be made to the logical primitives of macro-pen 4, taking into account the prior alignment of the ODD and EVEN logical primitives of that macro-pen, as was discussed with regard to FIG. 7. The firing times for the nozzles of macro-pen 2 would typically not be modified as that macro-pen would typically have been previously aligned in the scan axis and is being employed as a reference.

Figure 9:
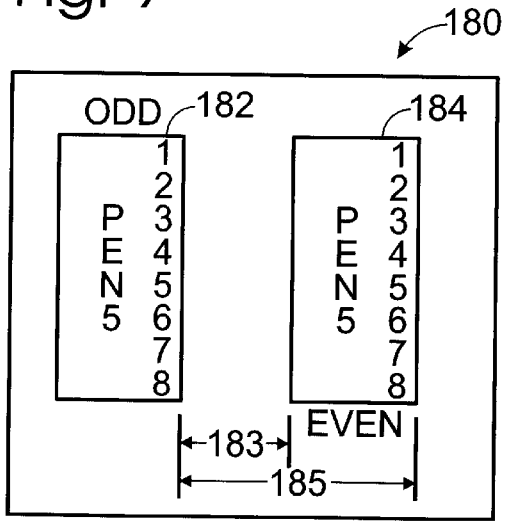
FIGS. 9–10 are drawings illustrating test block patterns that may be employed to align individual pens in a scan axis in accordance with the invention.
Figure 10:
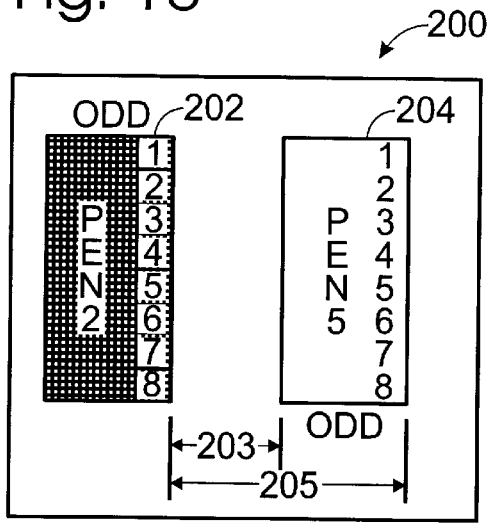

FIGS. 9 and 10 are drawings illustrating embodiments of test block patterns 180 and 200 that may be employed for aligning individual pens, such as pen 20 (PEN5), with a first macro-pen, such as aligned macro-pen 2 in the scan axis. Referring specifically to FIG. 9, an embodiment of a test block pattern that may be employed for aligning the ODD logical primitives of individual pen 20 (PEN5) with the EVEN logical primitives of that individual pen in accordance with the invention is illustrated. In this respect, for this particular embodiment, sub-patterns 182 and 184; and distances 183 and 185 may be employed for aligning the ODD and EVEN logical primitives of the individual pen in a substantially similar manner as sub-patterns 122 and 124 of FIG. 6 were employed to align the ODD and EVEN logical primitives of macro-pen 2 with an exception being that individual pen 20 (PEN5) has no associated counterpart pen and, therefore, is not a macro-pen. It is noted that similar patterns and techniques may be employed to align the ODD and EVEN logical primitives of other individual pens, and the invention is not limited in scope to embodiments including any particular number of individual pens.

FIG. 10 is a drawing illustrating a test block pattern 200 that may be employed for aligning macro-pen 2 with individual pen 20 (PEN5). Such a technique, as will now be described, may also be employed for aligning additional individual pens. In a similar respect as was indicated with regard to FIGS. 5–9, sub-patterns 202 and 204 would typically be adequate to accomplish such an alignment, though additional instances of these sub-patterns may be advantageous in certain respects, such as, for example, improving alignment accuracy. As indicated in FIG. 10, sub-pattern 202 may be printed with the ODD logical primitives of previously aligned sub-pen pen 14 (PEN2) of macro-pen 2 and sub-pattern 204 may be printed with the ODD logical primitives of individual pen 20 (PEN5).

By scanning sub-patterns 202 and 204 with sensor 36 in the scan axis, relative distances between the patterns for each logical primitive may be acquired, such as the distances indicated at 203 and 205. In turn, any misalignment in the scan axis between sub-pen pen 14 (PEN2) of macro-pen 2 and individual pen 20 (PEN5) may be determined by comparing those distances with each other and with expected values. Any misalignment between in the scan axis may be compensated for, at least in part, by adjusting firing times for the nozzles of one or more logical primitives of those pens. Typically, such adjustments would be made to the logical primitives of individual pen 20 (PEN5), taking into account the prior alignment of the ODD and EVEN logical primitives of that individual pen, as was discussed with respect to FIG. 9. The firing times for the nozzles of sub-pen pen 14 (PEN2) of macro-pen 2 would typically not be modified as that macro-pen, and its sub-pens, would have been previously aligned in the scan axis and is being employed as a reference for this embodiment. Techniques for implementing such adjustments have been previously discussed.

Figure 11:
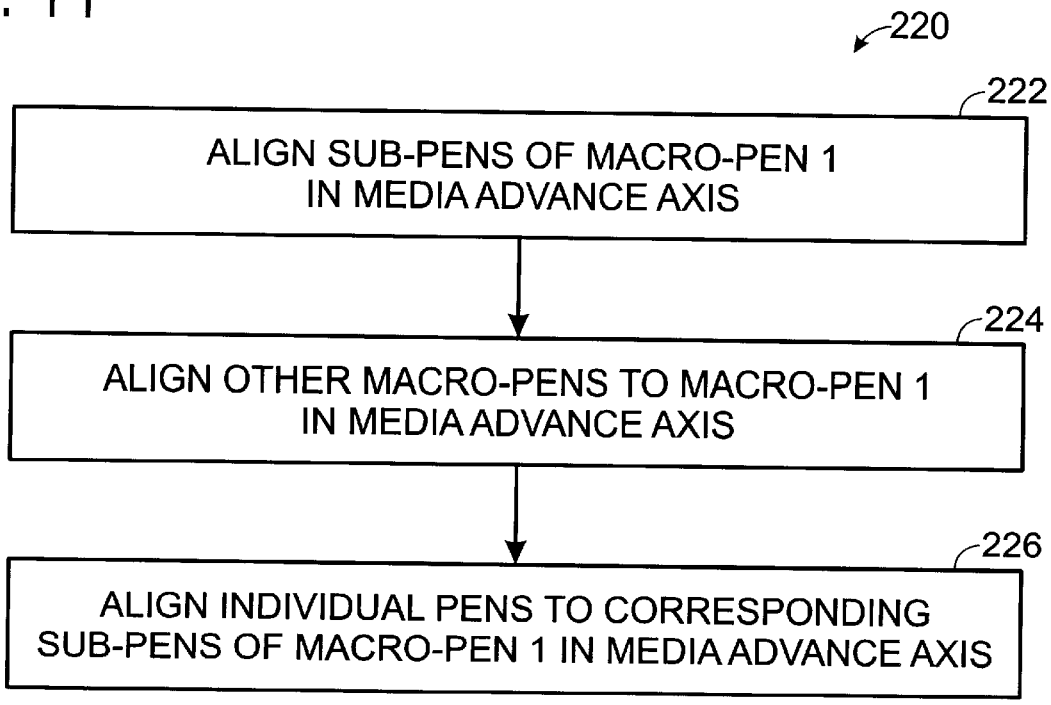
FIG. 11 is a flowchart illustrating an embodiment of a method for aligning macro-pens and individual pens in a media advance axis in accordance with one embodiment of the invention.

FIG. 11 is a flowchart 220 illustrating an embodiment of a method in accordance with the invention for aligning macro-pens and individual pens in a printer in a media advance axis. Such a method may employ a test block pattern, such as test block pattern 40, illustrated in FIG. 4. For this embodiment, at 222, the sub-pens of a first macro-pen are aligned in the media advance axis. While the invention is not limited in this respect, such an alignment may be accomplished using the techniques discussed above with respect to FIG. 4. At 224, the one or more other macro-pens may be aligned with the first macro-pen in the media advance axis by employing, for example, previously described techniques. At 226, any individual pens may be aligned with the first macro-pen in the media advance axis, as has been previously described with regard to FIG. 4, for example.

Figure 12:
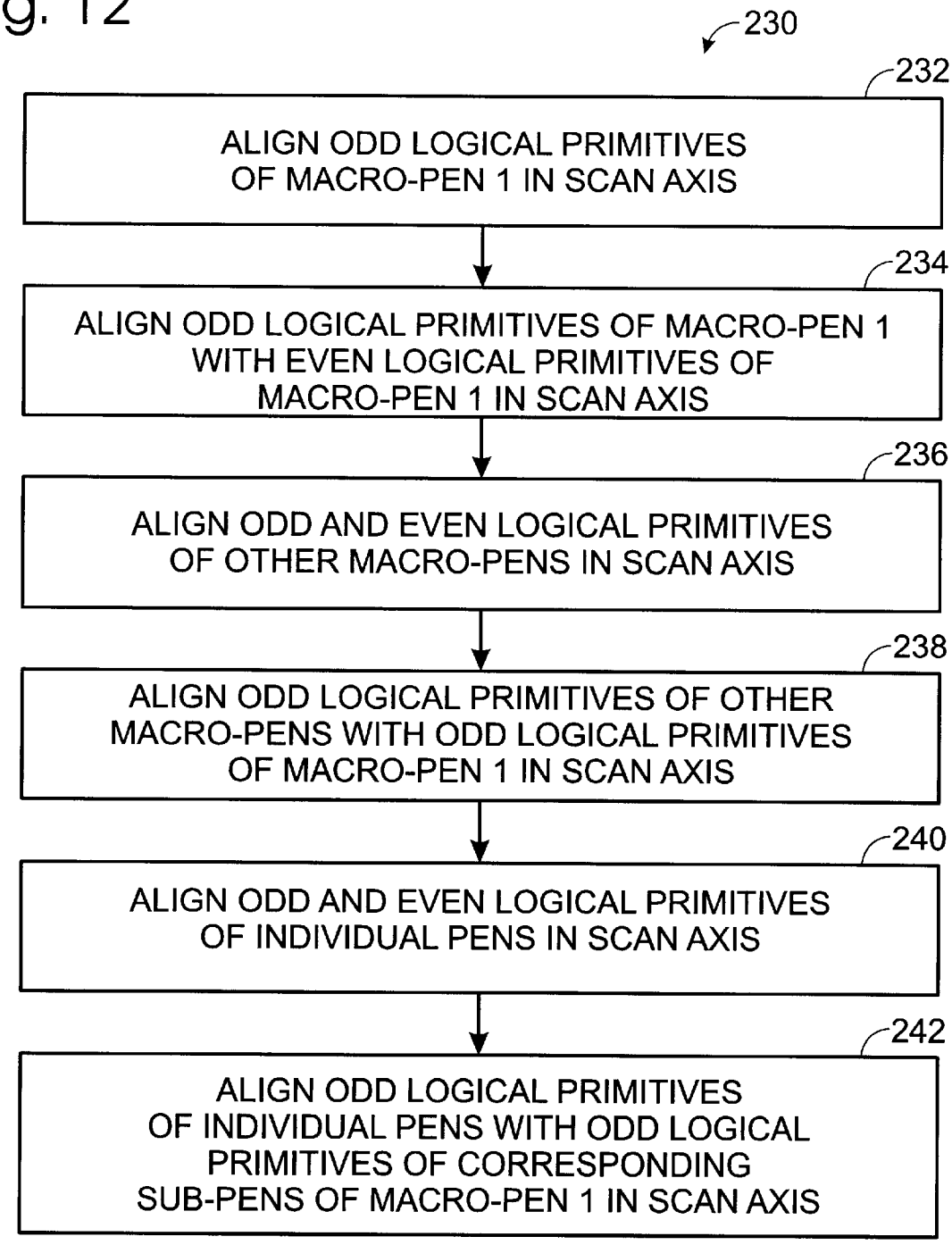
FIG. 12 is a flowchart illustrating a method for aligning macro-pens and individual pens in a scan axis in accordance with one embodiment of the invention.

FIG. 12 is a flowchart 230 illustrating an embodiment of a method in accordance with the invention for aligning macro-pens and individual pens of a printer in a scan axis. Such a method may employ test block patterns, such as those illustrated in FIGS. 5–10, as were previously discussed. At 232, the ODD logical primitives of a first macro-pen are aligned in the scan axis as was discussed with respect to FIG. 5. At 234, the EVEN and ODD logical primitives of the first macro-pen are aligned in the scan axis by employing, for example, techniques such as the ones discussed with respect to FIG. 6. At 236, the ODD and EVEN logical primitives of one or more other macro-pens are aligned in the scan axis by employing techniques such as those described with respect to FIG. 7. At 238, the one or more other macro-pens are aligned with the first macro-pen by employing techniques such as those described with respect to FIG. 8. At 240, the ODD logical primitives of any individual pens are aligned with the EVEN logical primitives of those individuals pens, such as was described with respect to FIG. 9. At 242, the individual pens are aligned with the first macro-pen in the scan axis using, for example, techniques such as those described with respect to FIG. 10.

While the present invention has been particularly shown and described with reference to the foregoing depicted embodiments, those skilled in the art will understand that many variations may be made therein without departing from the spirit and scope of the invention as defined in the following claims. The description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring nor excluding two or more such elements.

We claim:

1. A method of aligning plural staggered pens in a printer, a first pen and a second pen of the plural pens, the first and second pens being staggered, the method comprising:

defining a macro-pen including the first and second pens;

aligning the first and second pens of the macro-pen;

aligning a third pen with the macro-pen.

2. The method of claim 1, wherein aligning the first and second pens of the macro-pen includes aligning the first and second pens in a media advance axis.

3. The method of claim 1, wherein aligning the first and second pens of the macro-pen includes aligning the pens in a scan axis.

4. The method of claim 1, wherein aligning the third pen with the macro-pen includes aligning the third pen with the macro-pen in the media advance axis.

5. The method of claim 1, wherein aligning the third pen with the macro-pen includes aligning a first set of nozzles of the third pen with a second set of nozzles of the third pen in a scan axis; and aligning the first set of nozzles of the third pen with a set of nozzles of the macro-pen in the scan axis.

6. The method of claim 1, further comprising aligning a fourth pen with the macro-pen, the third and fourth pens being staggered and defining a second macro-pen.

7. A method of aligning plural staggered pens in a printer, a first pen and a second pen of the plural pens, the first and second pens being staggered along a media advance axis, the method comprising:

defining a macro-pen including the first and second pens;

aligning the first and second pens of the macro-pen in a media advance axis; and aligning a third pen with the macro-pen in the media advance axis.

8. The method of claim 7, wherein aligning the first and second pens of the macro-pen includes directing the printer to print a pattern with the first and second pens, the pattern including references and alignment blocks, measuring relative distances between the references and the alignment blocks;

determining a misalignment of the first and second pens in the media advance axis based on the relative distances; and modifying a set of active nozzles for the first pen to compensate for the determined misalignment.

9. The method of claim 7, wherein aligning the third pen of the printer includes directing the printer to print a pattern with the macro-pen and the third pen, the pattern including a reference and an alignment block, measuring relative distances between the reference and the alignment block;

determining a misalignment of the third pen with the macro-pen in the media advance axis based on the relative distances; and modifying a set of active nozzles for the third pen to compensate for the determined misalignment.

10. The method of claim 7, further comprising aligning a fourth pen with the macro-pen in the media advance axis, the third and fourth pens being staggered and defining a second macro-pen.

11. A method of aligning plural staggered pens in a printer, a first pen and a second pen of the plural pens defining a macro-pen, the first and second pens being staggered along a media advance axis, the method comprising:

aligning the first and second pens of the macro-pen in the scan axis; and aligning the third pen with the macro-pen in the scan axis.

12. The method of claim 11, wherein aligning the first and second pens of the macro-pen in the scan axis includes:

aligning a first set of nozzle groupings of the macro-pen in the scan axis; and aligning the first set of nozzle groupings of the macro-pen with a second set of nozzle groupings of the macro-pen in the scan axis.

13. The method of claim 12, wherein aligning the first set of nozzle groupings of the macro-pen in the scan axis includes printing a first pattern with a first portion of the first set of nozzle groupings;

advancing a print media a predetermined amount, the predetermined amount corresponding to a nozzle grouping height;

printing a second pattern with a second portion of the first set of nozzle groupings;

measuring relative distances between the first and second patterns;

determining a misalignment of the first set of nozzle groupings of the macro-pen based on the relative distances; and adjusting nozzle firing times for the first set of nozzle groupings of the macro-pen to compensate for the determined misalignment.

14. The method of claim 12, wherein aligning the first set of nozzle groupings of the macro-pen with the second set of nozzle groupings of the macro-pen in the scan axis includes printing a first pattern with the first set of nozzle groupings;

printing a second pattern with the second set of nozzle groupings;

measuring relative distances between the first and second patterns;

determining a misalignment between the first set of nozzle groupings and the second set of nozzle groupings based on the relative distances; and adjusting nozzle firing times for the second set of nozzle groupings to compensate for the determined misalignment.

15. The method of claim 11, wherein aligning the third pen to the macro-pen in the scan axis includes aligning a first set of nozzle groupings of the third pen with a second set of nozzle groupings of the third pen in the scan axis; and aligning a first set of nozzle groupings of the macro-pen with the first set of nozzle groupings of the third pen in the scan axis.

16. The method of claim 11, further comprising aligning a fourth pen with the macro-pen in the scan axis, the third and fourth pens being staggered and defining a second macro-pen.

17. An article comprising:

a storage medium having a plurality of machine-readable instructions, wherein when the instructions are executed, the instructions provide for:

aligning a first pen and a second pen of a plurality of staggered pens in a printer, wherein the first pen and the second pen are staggered along a media advance axis and define a macro-pen;

aligning a third pen with the macro-pen; and aligning a fourth pen with the macro-pen, the third and fourth pens being staggered along the media advance axis.

18. The article of claim 17, wherein aligning the first and second pens of the macro-pen includes aligning the first and second pens in a media advance axis.

19. The article of claim 17, wherein aligning the first and second pens of the macro-pen includes aligning the pens in a scan axis.

20. The article of claim 17, wherein aligning the third pen with the macro-pen includes aligning the third pen with the macro-pen in the media advance axis.

21. The article of claim 17, wherein aligning the third pen with the macro-pen includes aligning a first set of nozzles of the third pen with a second set of nozzles of the third pen in a scan axis; and aligning the first set of nozzles of the third pen with a set of nozzles of the macro-pen in the scan axis.

22. The article of claim 17, the third and fourth define a second macro-pen.

23. A pen alignment system comprising:

a printer having plural pens, a first pen and a second pen of the plural pens defining a macro-pen, each pen of the plural pens having a plurality of nozzles configured to print a test block pattern, the test block pattern being arranged so as to allow determination of a first misalignment of the first and second pens of the macro-pen and to allow determination of a second misalignment of a third pen with the macro-pen; and a sensor for scanning the test block pattern to measure relative distances of the test block pattern to be employed in determining the first and second misalignment.

24. The pen alignment system of claim 23, wherein determining the first and second misalignments includes determining a first and second misalignment in a media advance axis.

25. The pen alignment system of claim 24, wherein determining the first and second misalignments includes determining a first and second misalignment in a scan axis.

* * * * *